United States Patent [19]

Schröter et al.

[11] 3,955,711

[45] May 11, 1976

[54] DISPENSER FOR SELF-STICK STRIP-CARRIED LABELS

[75] Inventors: Carl Schröter, Rommelshausen; Friedrich Kirchdörfer, Stuttgart-Wangen, both of Germany

[73] Assignee: Heinrich Hermann, Stuttgart, Germany

[22] Filed: July 25, 1974

[21] Appl. No.: 491,630

[30] Foreign Application Priority Data

July 26, 1973 Germany ..... 2337946

[52] U.S. Cl. ..... 221/73; 156/541; 156/577; 156/579; 156/584

[51] Int. Cl.[2] ..... B65C 9/18; B65H 5/28

[58] Field of Search ..... 156/577, 584, 574, 344, 156/523, 521, 541, 352, 361, 384, 579, DIG. 33; 221/71–73

[56] References Cited

UNITED STATES PATENTS

| | | | |
|---|---|---|---|
| 2,634,877 | 4/1953 | Kaplan | 156/523 |
| 3,026,239 | 3/1962 | Porter | 156/584 |
| 3,468,743 | 9/1969 | Soriano | 156/584 |
| 3,477,896 | 11/1969 | Townsend et al. | 156/584 |

*Primary Examiner*—William A. Powell
*Assistant Examiner*—Michael G. Wityshyn
*Attorney, Agent, or Firm*—Kenyon & Kenyon Reilly Carr & Chapin

[57] ABSTRACT

A dispenser for self-stick labels removably stuck on one side of a flexible carrier strip in a row extending longitudinally along the strip, has a forwarding device for forwardly moving the strip and a strip deflector on which the forwardly moving strip is deflected away from the labels to peel the strip therefrom for dispensing the labels. The forwarding device is positioned ahead of the deflector so that the strip carrying the labels is pushed to the deflector, the latter having a concave surface and being behind the forwarding device and arranged so that the concave surface is engaged by the side of the strip carrying the labels. When the strip is forwarded, it is deflected by sliding downwardly and backwardly in the concave surface so as to peel from the labels, the latter being pushed over the top of the deflector for dispensing. Every label carried by the strip can be dispensed, including those on the front end of the strip.

17 Claims, 10 Drawing Figures

FIG.3
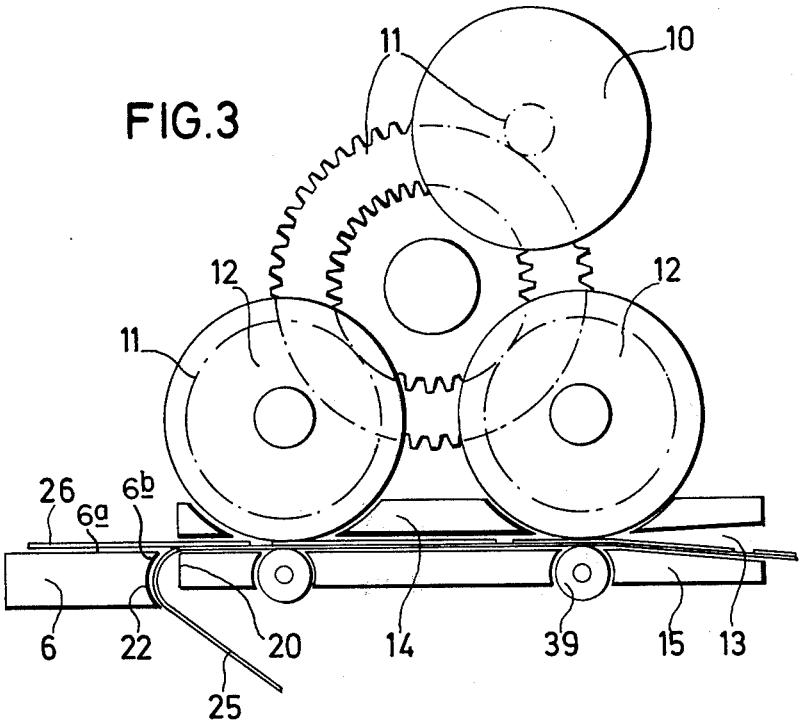
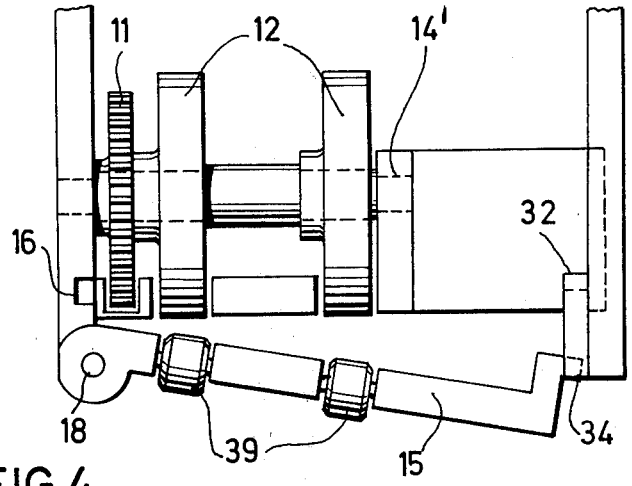
FIG.4

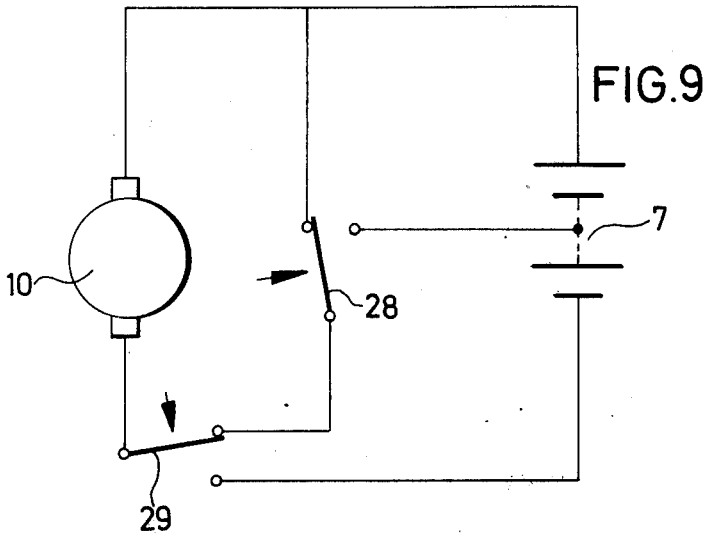
FIG.9
FIG.9a
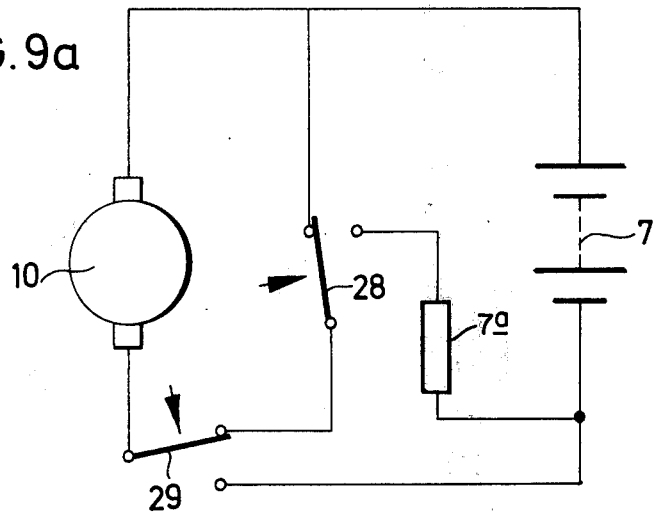

DISPENSER FOR SELF-STICK STRIP-CARRIED LABELS

BACKGROUND OF THE INVENTION

This invention relates to dispensers for self-stick labels removably stuck on one side of a flexible carrier strip in a row extending longitudinally along the strip. The labels are normally stuck on the strip by pressure-sensitive adhesive, and when the strip is deflected sharply enough away from the labels, the strip peels from the labels leaving them free to be stuck to objects to be labeled, via the adhesive.

A dispenser for such labels conventionally has a forwarding device for forwardly moving the strip while carrying the labels, and a strip deflector on which the forwardly moving strip is deflected or bent away from the labels sharply enough to peel the strip from the labels. The forwarding device is normally operated intermittently so that the labels are intermittently dispensed. The dispenser usually includes a presser for pressing the labels on the objects, after the labels are freed from their carrier strip.

Examples of such dispensers are provided by the following U.S. patents:

Satas U.S. Pat. No. 3,231,446 dated Jan. 25, 1966

Kind et al. U.S. Pat. No. 3,265,553 dated Aug. 9, 1966

Kaplan U.S. Pat. No. 3,420,172 dated Jan. 7, 1969

Schrotz et al. U.S. Pat. No. 3,674,609 dated July 4, 1972

The dispensers of all of these patents show the characteristic prior art arrangement wherein the strip carrying the labels is pulled around the strip deflector by the strip forwarding device which is located behind the deflector in the sense that the strip meets the deflector first before engagement with the forwarding device. There are various kinds of strip forwarding devices, but in all instances the purpose is to engage the strip and pull it under tension over and around the strip deflector which itself may be anything bending the pulled strip sharply enough to peel the strip from the labels.

The above described characteristic prior art arrangement has objectionable operational drawbacks. Conventionally the strip carrying the labels is in the form of a supply coil which must be positioned in the dispenser and its leading end initially threaded to put the dispenser initially into operation, and one drawback is that these prior art dispensers require a relatively long length of the strip to be manually pulled around the deflector and engaged with the strip forwarding device behind the deflector, this operation requiring time-consuming training of the operators of the dispensers.

Another drawback is that even though the threading operation is properly done, the length of strip carrying the labels which must be fed from the supply coil over the deflector and back to the strip fowarding device behind the deflector, is necessarily of undesirable extent, all of the labels on this length representing label waste at least, and in the case of a forwarding device which cannot effectively engage the carrier strip while carrying the labels, a time waste occasioned by the necessity to manually remove and waste the labels from the strip's length required for engagement with the forwarding device.

Still another drawback is that the described label waste is unpredictable, depending on the person who must put the dispenser into initial operation. This interferes with business management practices requiring knowledge of the number of labels fixed to the objects labeled. In other words, although a supply coil may be known to contain a certain number of labels, there is no way to assure the management that that number of labels has been applied to a corresponding number of objects.

SUMMARY OF THE INVENTION

An object of the present invention is to provide a dispenser of the general type described but avoiding the previously referred to drawbacks while having, in addition, additional advantages.

To achieve this object, the present invention provides a strip forwarding device positioned ahead of a strip deflector, instead of behind. This forwarding device is a means for pushing the strip forwardly to the deflector. Further, the deflector itself has a concave strip-engaging surface and is positioned behind the forwarding device and for engagement by the side of the strip carrying the labels. With this invention, the strip forwarding device pushes the strip carrying the labels, forwardly against the concave surface of the deflector, the leading edge of the strip, during initial threading, engaging the cancave surface and being deflected in a direction away from the labels, and, normally, backwardly, the strip being in this way progressively peeled from the labels, the labels being pushed forwardly over the top of the deflector by their trailing ends remaining on the strip, their forward ends being exposed behind the deflector for pressing on the objects being labeled.

Because the leading edge of a new supply coil of the strip carrying the labels, is pushed forwardly by the forwarding device, to engage the concave deflector surface, with the strip then being deflected away from the labels with the described peeling action, the very first label on the extreme leading end of the strip initially fed from the supply coil, is peeled off for dispensing, with each successively following label being dispensed in an orderly manner.

Initial threading is substantially automatic, a supply coil being inserted in the dispenser with its leading end of strip carrying the labels, engaged by the forwarding device, operation of the latter then effecting the threading and dispensing of the first label. Operator training is substantially unnecessary.

To make this concept more effective, plate guides above and below the strip pushed by the forwarding device, which may be one or more sets of pinch rolls, prevent the pushed strip from buckling under the compression it receives when pushed against the concave surface of the deflector. This surface extends not only transversely with respect to the forwardly pushed strip carrying the labels, but diagonally with respect thereto, this providing the advantage that initial peeling away of the strip from the labels is more positively initiated, while reducing the force required for the forward push via the strip to the deflector surface, because the peeling is progressive from one side of the strip to the other side and not all at once across the full width of the strip. The labels are pushed forwardly over the top of the deflector, by the labels' trailing parts remaining stuck on the forwarding strip, to position the labels under a pressing shoe or the like so that they may be pressed against the objects to be labeled.

The carrier strip for the labels has an edge portion free from the labels. To aid in initial threading, the dispenser is provided with means for initially bending this edge portion at the leading end of the forwarding strip, downwardly to tuck the advancing edge of the label-carrying strip downwardly under the most forward or leading edge of the diagonally arranged deflector surface, this providing more positive assurance that the strip will initially be deflected downwardly to initially peel itself away from the first label carried by the strip.

BRIEF DESCRIPTION OF THE DRAWINGS

The presently preferred mode for carrying out the invention is illustrated by the accompanying drawings, in which:

FIG. 3 on an enlarged scale shows a strip forwarding device and deflector;

FIG. 4 is a cross section showing details of the strip forwarding device;

FIG. 9 is a diagram showing the circuitry used when the illustrated dispenser is powered by an electric motor; and FIG. 9*a* is a modification of the circuitry of FIG. 9.

DETAILED DESCRIPTION OF THE INVENTION

Figure 1:
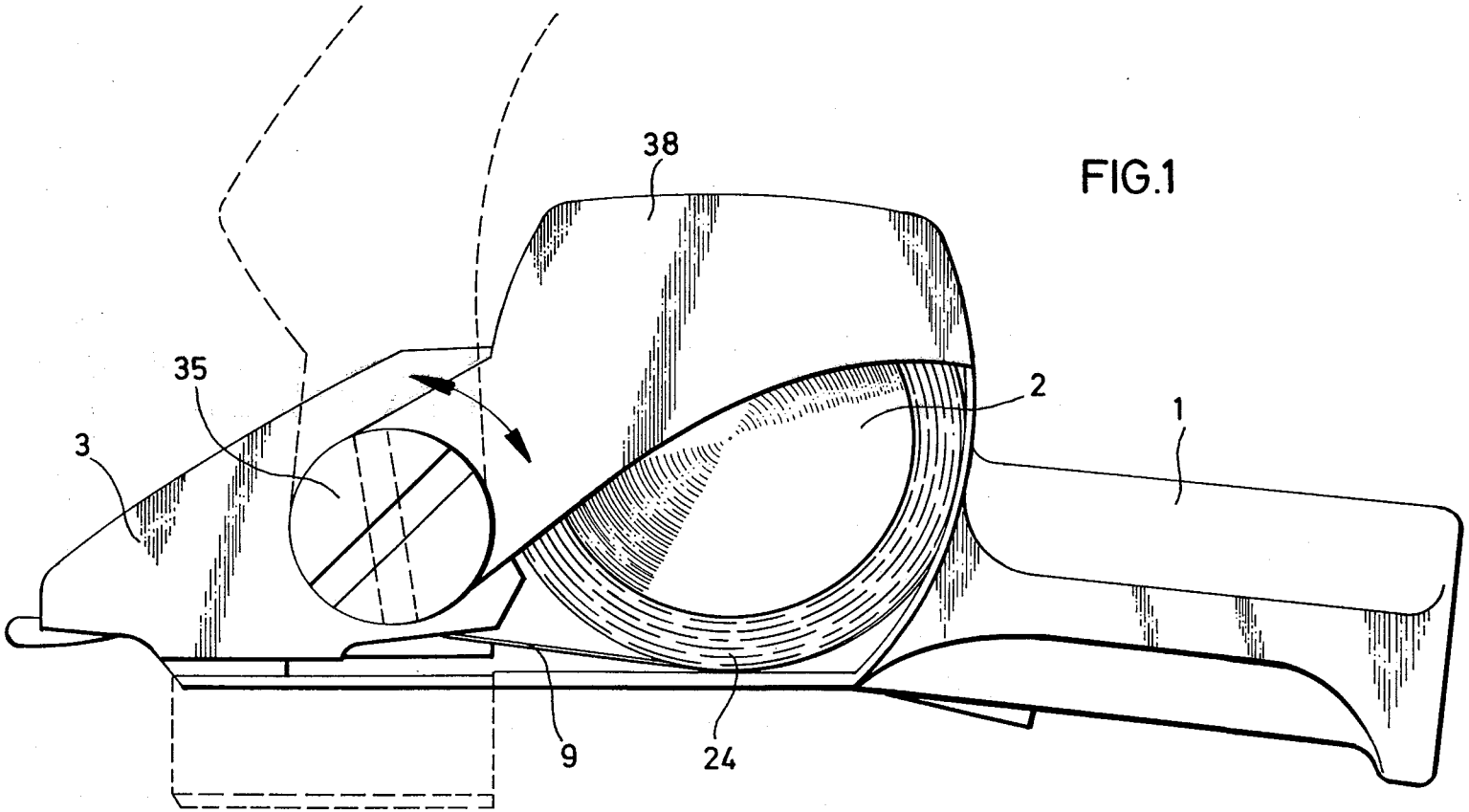
FIG. 1 is a side view showing the external appearance of the dispenser.
Figure 2:
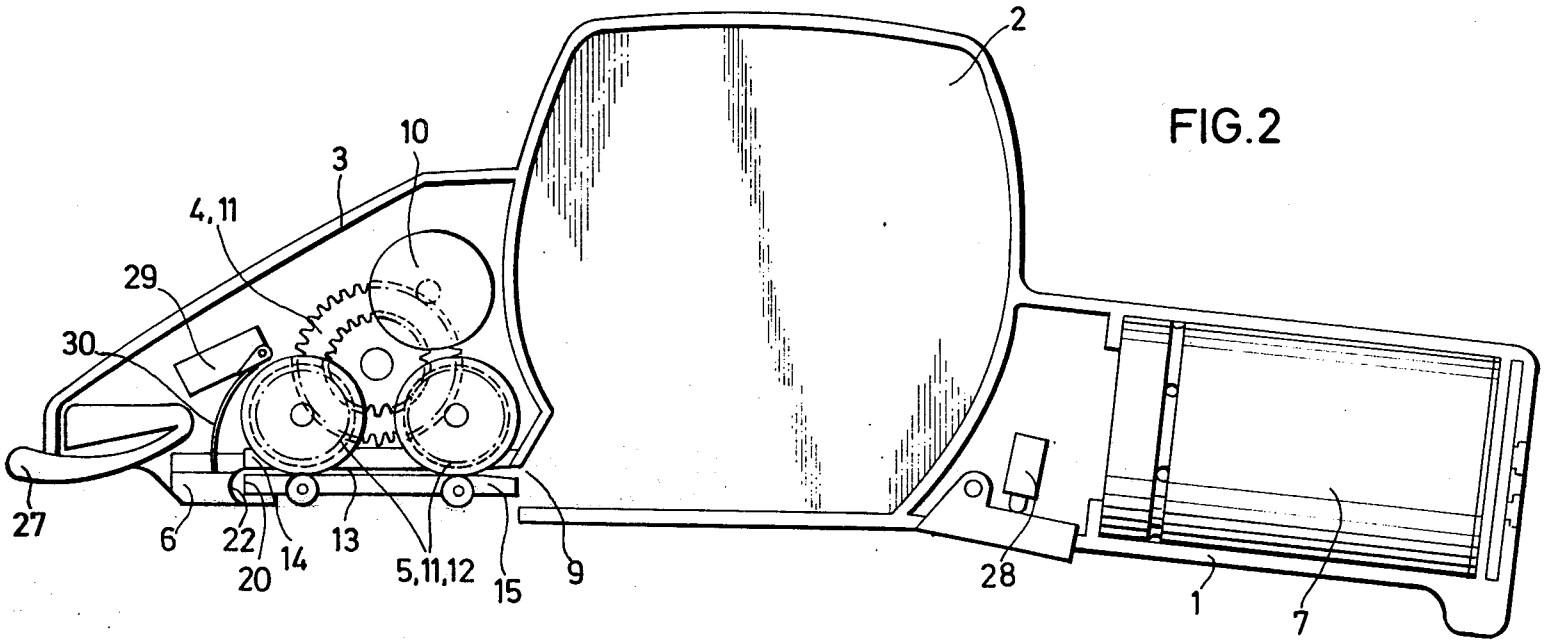
FIG. 2 is a longitudinally extending vertical section of that dispenser.

The dispenser's external appearance is shown by FIG. 1. The dispenser has a housing providing a hand-held handle 1, a chamber 2 for holding a supply coil of the strip carrying the labels, and a forward or nose portion 3 which houses the operating mechanism of the dispenser. FIG. 2 shows that in this nose portion 3 there is a reduction gear drive 4 connecting with a pinch-roll type of forwarding device 5. For reasons already explained, this forwarding device 5 is ahead of or in front of the deflector 6 providing the concave deflecting surface. The illustrated dispenser is electrically powered; therefore, a battery 7 is positioned within the handle 1.

For threading of the forward end of a new supply coil or strip, this end is inserted and pushed slightly forwardly into a mouth 9 which flares backwardly for easy insertion of the leading end of the strip. An electric motor 10 powered by the battery 7, via the gear drive 4, comprising the gear train 11, then drives pinch roll sets via their upper and larger rolls 12, of which there are two, forwardly to forward the strip. The newly fed end of the strip carrying the labels is thus fed forwardly through a guide channel 13 to the deflector 6. This guide channel 13 is formed by an upper guide plate 14 and a lower guide plate 15, normally vertically interspaced about from 0.3 to 1 mm, the exact distance depending on the thickness of the carrier strip and the labels it carries. The larger upper rolls 12 project downwardly through openings in the upper guide plate 14 so that their roll peripheries extend downwardly into the guide channel 13 to engage the strip.

The upper guide plate 14 forms a flat smooth strip guiding surface and has one side positioned in a groove 16 formed in the inside of the housing or frame of the nose portion 3, on the left-hand side as seen as FIG. 4, while on its other side, arms 17 (see FIG. 6) extend to the opposite side of the nose portion 3 to which the ends of these arms are attached. The arms 17 extend from a vertical plate portion 14' which together with the portion of the nose portion opposite thereto, serve to journal the shafts of the upper rolls 12.

The lower plate 15 on its left-hand side, as viewed in FIG. 4, is connected with the nose portion 3 by way of a hinge 18. The upper guide plate has a rear edge 19 and the lower guide plate has a rear edge 20, both behind the rolls 12.

Figure 5:
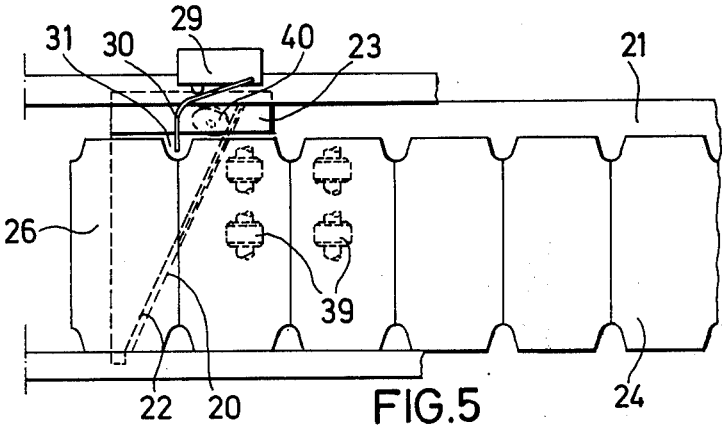
FIG. 5 is a horizontal section on a plane below the upper guide plate and showing the labels being peeled from the carrier strip, the diagonal arrangement of the strip deflector surface, and details providing controlled intermittent strip feeding for label-by-label dispensing.
Figure 6:
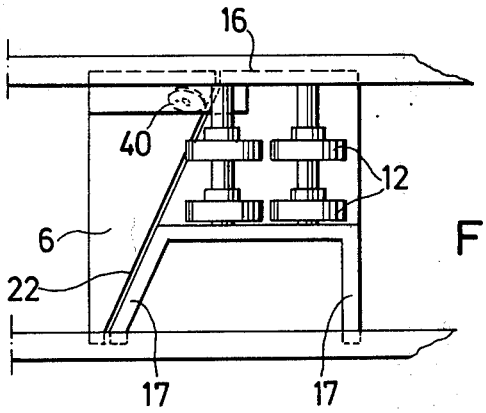
FIG. 6 is the same as FIG. 5 but is taken on a plane above the upper guide plate and shows some of the elements of the forwarding device and in more detail the diagonal arrangement of the strip deflector surface.
Figure 7:
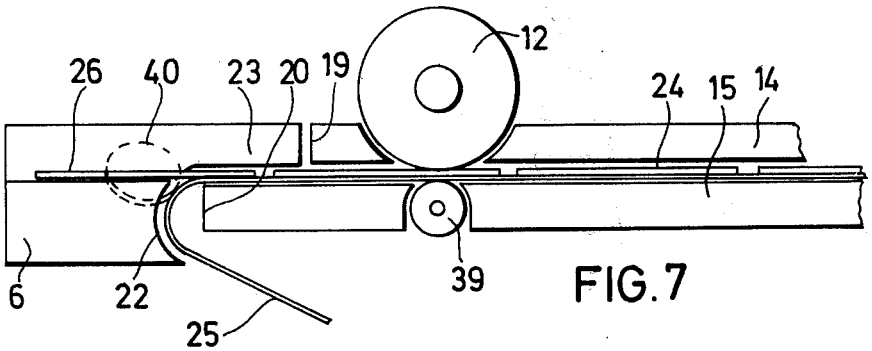
FIG. 7 is a vertical longitudinally extending section showing the concavity of the strip deflector and the action involved by its peeling the carrier strip from the labels.

Referring particularly to FIGS. 5 to 7, when the carrier strip is pushed forwardly by the forwarding rolls 12, the leading edge of the strip, but not the labels, engages just beneath the relatively sharp upper edge of the backwardly facing concave surface 22 of the deflector 6. The surface 22 is at least approximately a cylindrical segment and the guideway 13 is aligned substantially tangentially with the top edge portion of this surface. The lower guide plate 15 has its strip guiding surface below the surface's top edge portion a distance about equaling the thickness of the carrier strip up to its interface with the labels.

The carrier strip has an exposed edge 21 free from the labels, and to initiate its deflection, a carrier strip edge depresser 23 is positioned, with a downwardly curved depressing surface, to initially deflect this exposed edge portion downwardly for bending downwardly and backwardly via the surface 22, with the balance of the strip leading edge following, to peel the strip from the label. This device, which may be called an auxiliary or strip edge deflector, is shown particularly well by FIGS. 5 to 7, as positioned to one side to engage only the free edge portion 21 of the carrier strip, and as shown by FIG. 7, this auxiliary deflector 23 has a strip-edge engaging surface which is substantially arcuate and concentric with the concave surface 22; the deflector 28 surface has about the same curvature radius as the surface 22. The bottom edge of the deflecting surface of the part 23 extends downwardly to, in effect, initially tuck the edge of the strip downwardly into the surface 22 of the deflector 6 to initiate the deflecting action as a whole.

In FIGS. 5 and 7 in particular, the labels are shown at 24 and, in FIGS. 3 and 7, the carrier strip per se is shown at 25. FIGS. 3, 5 and 7 show the peeled off labels 26 as they are being dispensed forwardly over the upper surface of the deflector 6. As shown by FIG. 2, each forwardly advanced peeled off label may be dispensed by pressing it against the object to be labeled, via a pressure shoe 27 mounted in the front end of the nose portion 3.

Reference to FIGS. 5 and 6 show that the concave surface 22 of the deflector 6, against which the forwardly pushed strip 25 is pressed for deflection, extends transversely with respect to the carrier strip and labels, in a diagonal manner. This also applies to the edge 20 of the lower guide plate 15 and, preferably, to the edge 19 of the upper guide plate 14. The angularity of this diagonal arrangement is preferably about 70° from the direction of movement of the strip, but the angularity may range from 45° to 80°, a 45° angularity causing the strip to peel from the labels with the minimum of strip forwarding distance. This diagonal arrangement has the advantage that when pushing the strip between the upper and lower guide plates 14 and 15 which prevent the strip from buckling while being pushed, the auxiliary deflector 23 can tuck the advancing strip edge portion 21 downwardly below the upper edge of the initially engaged portion of the concave deflector surface 22, the balance of the strip then deflecting automatically by following this leading portion. Also, the peeling action continues progressively toward the other side, as the label is pushed over the upper surface of the deflector 6 until the last bit of label engaged by the strip is detached. The label is pushed over the upper surface of the deflector 6 far enough for at least the forward end of the label to be pressed against the surface of the object to be labeled, by the presser 27. Although not shown, the upper surface of the deflector may be coated with an adhesive-repellant material, provided with longitudinally extending ribs, etc., if the label adhesive is such that sticking to this upper surface is experienced.

Having reference now to FIGS. 2, 5 and 9 and 9a, the motor 10 is powered by the battery 7 under the control of a finger actuated switch 28. The labels 24 have interposed between them indents which serve to monitor the feeding of the labels, a two-pole micro-limit switch 29 being provided with a feeler 30 which can either enter the indents 31 or ride along the edges of the labels 24. The circuitry is shown by FIG. 9 where it can be seen that when the two-pole switch 28 is closed with the right-hand contact, the voltage of half of the battery 7 is applied to the motor 10 for a slow start. The strip 25 is then pushed forwardly so that the feeler 30 rides on the edge of an oncoming label, this throwing the switch 29 to its lower contact to apply the full voltage of the battery 7 to the motor 10 while permitting the switch 28 to return to its left-hand contact to which this switch is spring biased. When the feeler 30 enters the next of the indents 31, the switch 29 returns to the connection shown by FIG. 9, the motor 10 then being de-energized and short circuited so that it is dynamically braked, but ready for feeding of the next label upon subsequent operation of the switch 28. FIG. 9*a* shows a circuit wherein a resistor 7*a* is used for reducing the voltage initially supplied to the motor 10 upon first finger actuation of the switch 28 and prior to the switch 29 being thrown by the feeler 30 riding along the edge of an oncoming label.

Figure 8:
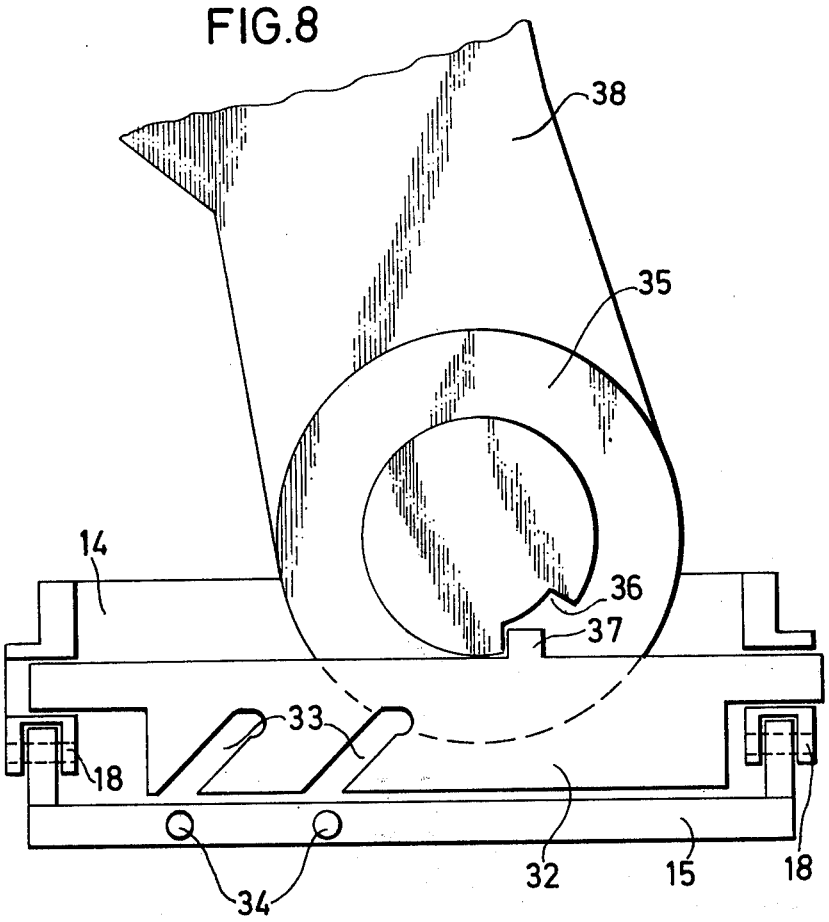
FIG. 8 in vertical section shows details taken from FIG. 4.

As previously noted, the lower guide plate 15 is hinged at 18 so that it may be swung downwardly away from the upper guide plate. For the control of this action, as shown by FIG. 8, a linearly sliding cam 32 is slidably mounted inside of the nose or forward portion 3 and is provided with angular cam slots 33 in which pins 34 can be engaged, these pins 34 being connected to the swinging end of the lower guide plate 15 as shown by FIG. 4. With this arrangement the lower guide plate 15 can either be firmly positioned at a predetermined spacing relative to the upper guide plate 14, or, possibly, at adjustable distances determined by the angularity of the cam slots 33 and the linear positioning of the cam plate 32. In general, the purpose is to permit the actuation of the cam plate 32 to completely release the pins 34 so that the lower guide plate 15 can be swung down to permit access to its surface and the bottom surface of the upper guide plate.

To control the linear motion of the cam plate 32, the dispenser has journaled to it a rotary knob 35 provided with a peripheral, arcuate indent 36 engaging an upwardly extending pin 37 which is part of the plate 32, rotation of this knob 35 thus serving to move the plate 32 back and forth for adjustment or release of the lower guide plate 32. This knob is connected with a lever arm 38 which is designed as a plate to cover wholly or partially the supply coil of strip-carried labels in the receptacle or mounting pocket 2, preventing the coil from falling out after its installation and when the dispenser is in operation.

The lower guide plate 15 is provided with small idle rolls 39 which extend upwardly through openings in the lower plate, being journaled to the latter, these small rolls 39 and the larger rolls 12 which are driven, forming the two pinch roll sets. The rolls 12 and 39 may advantageously be rubber covered, but it is to be noted that slippage between the rolls 12 and the strip, if not excessive, is unimportant, because the monitoring of the label feeding is determined by the feeler 30 as previously described.

The auxiliary strip edge deflecting or initial guide 23, must engage the carrier strip frictionally. To smooth the operation and make it more positive, an anti-friction roller 40 is journaled so that its peripheral portion extends to act as a continuation of the initial guiding surface of the part 23. The axis of this roller is parallel to the diagonal axis of the concave surface 22 of the main deflector 6. The axis of this roller is a little higher than the center line extending between the upper and lower guide plates 14 and 15 respectively. The periphery of this roller 40 should extend downwardly below this center line as indicated by FIG. 7. This roller has the advantage that it reduces the possibility of the dispenser's operation being interfered with if particles of pressure sensitive adhesive become deposited at locations interfering particularly with initial forward actuation of the advancing end of a new supply coil of the label-carrying strip.

Keeping in mind the previously described drawbacks of the prior art dispensers, it can be seen that with this new dispenser, an inexperienced person can place a supply coil in the receptacle or reception chamber 2, the cover 38 being in its open position and the lower guide plate 15 hanging downwardly. This makes it easy to place the leading end of the label-carrying strip under at least the first of the two forwarding rolls 12. Then the lower guide plate 15 is pushed upwardly so that the pins 34 enter the slots 33, closing of the receptacle 2 to retain the new supply coil automatically placing the lower guide plate at its proper operating position with the leading end of the strip pinched between at least the first of the forwarding rolls 12 and its opposite pinch roll 39. This is all that is required; it is well within the skill of an inexperienced person.

The forward ends of the guide plates 14 and 15 angle away from each other in vertical directions, to form the mouth 9 for the guide channel 13, their diagonal ends 19 and 20 extending close to and parallel with the diagonal deflector surface 22. As shown by FIG. 1, this mouth 9 and the leading end of a new coil of the label-carrying strip, are laterally exposed. Therefore, even without lowering the lower guide plate, it is possible to push this leading end through the mouth 9 to the first set of pinch rolls, press the finger operated switch 28, and obtain a slow forwarding speed to feed the carrier strip slowly forwardly until the switch 29 provides full forwarding speed to feed the first label, release of the finger-operated switch, stopping the feed after providing the first label for dispensing. Thus, threading is automatic in the practical sense.

The deflector has, as shown by FIG. 3, for example, a forwardly extending flat top surface 6*a* joining with the top edge of its concave surface 22 to form the sharp upper edge 6*b* pointing towards the forwarding strip carrying the labels. This edge is substantially aligned with the interface between the labels and the strip. Thus, the forward feeding initiates the strip peeling operation, aided and made more certain, by the strip edge engaging elements.

As shown by FIG. 6, the end edge of the deflector facing the presser 27, is at a right angle to the direction the labels are fed over the flat top of the deflector 6. The diagonal concave surface 22 extends almost to this end edge, so substantially the full length of each dispensed label, is exposed beyond this end edge of the deflector's top surface, for easy application to the object to be labeled.

What is claimed is:

1. A dispenser for self-stick labels removably stuck on one side of a flexible carrier strip in a row extending longitudinally along the strip, said dispenser having a forwarding device for forwardly moving the strip while carrying the labels, and a strip deflector means for deflecting and bending the forwardly moving strip sharply enough away from the labels to thereby peel the strip from the labels for dispensing the labels; wherein the improvement comprises said device being positioned ahead of said deflector with respect to the forwardly moving strip and comprising means for pushing the strip with the labels stuck thereon forwardly to said deflector means, and the deflector means being a deflector forming a surface of concave contour tangentially with respect to the strip and extending transversely with respect to and facing in a direction opposite to the forwardly moving strip and labels and being positioned behind said forwarding device with respect to the forwardly moving strip and for engagement by said side of the strip.

2. The dispenser of claim 1 having strip guide means for restraining said strip with the labels stuck thereon, from deflecting while being pushed by said device to said deflector.

3. The dispenser of claim 2 in which said deflector is a body forming said surface of concave contour and a forwardly extending flat top surface, the two said surfaces joining to form a leading edge pointing backwardly with respect to and towards the forwardly moving strip and substantially aligned with said side of the forwardly moving strip, said flat top surface supporting the labels from which the strip is peeled by the deflection and bending of the strip on the surface of concave contour.

4. The dispenser of claim 3 in which said labels have pressure-sensitive adhesive by which they are removably stuck on said side of the strip, and said flat top surface which receives the labels has means for at least reducing the adhesion of said adhesive thereto.

5. The dispenser of claim 3 in which said concave surface and edge extend diagonally to the direction of the forwardly moving strip.

6. The dispenser of claim 5 in which said surface and edge has an angularity ranging from about from 40° to 80°.

7. The dispenser of claim 3 in which said strip has a marginal edge portion free from said labels, and said leading edge extends in a direction causing the strip to initially engage said leading edge via the strip's said edge portion, said dispenser having means for guiding the strip's said edge portion to below said leading edge.

8. The dispenser of claim 7 in which said means for guiding the strip's said edge portion is a roller having a periphery engaged by the said edge portion and extending to a level below said leading edge of said body.

9. The dispenser of claim 8 in which said roller rotates on an axis substantially parallel to the axis of the deflector's said concave surface and positioned above said leading edge.

10. The dispenser of claim 3 in which said strip guide means comprises a lower guide plate normally positioned to slidingly support said carrier strip via said carrier strip's other side opposite said one side carrying the labels and with said first-named side substantially aligned with said leading edge of the strip deflector, and an upper guide plate positioned above said lower guide plate for guiding the strip and labels.

11. The dispenser of claim 10 in which said forwarding device comprises at least on pinch roller set of upper and lower rollers, the lower rollers thereof being journaled on said lower guide plate and the latter having openings through which the peripheries of the lower rollers project for supporting the carrier strip's said other side, and the upper rollers of said set having means for journaling them above said upper guide plate with the latter having openings through which the upper roller's peripheries project to engage said labels removably stuck on said strip, said upper rollers being of larger diameter than said lower rollers, and said dispenser means for rotatively driving said upper rollers.

12. The dispenser of claim 11 in which said lower guide plate journaling said lower rollers, has means for moving said lower guide plate away from said upper guide plate.

13. The dispenser of claim 12 in which said dispenser has a receptacle with an open side for receiving a supply coil of said strip carrying said labels, and said means for moving said lower guide plate is connected with means for at least partly covering said open side when said lower plate is normally positioned, movement of said covering means free from said open side causing said lower guide plate to be moved away from said upper guide plate by the lower guide plate's said moving means via said interconnection.

14. The dispenser of claim 13 in which said covering means is rotative and said lower guide plate moving means is a linear sliding cam plate, said lower guide plate having means engaging said cover plate and said rotative covering means being connected to said cam plate so that rotation of said covering means linearly moves said cam plate.

15. The dispenser of claim 1 having an electric motor powering said forwarding means, a battery for said motor, manual means for momentarily connecting said battery to said motor, and means actuated by said strip and labels moving forwardly for holding said battery connected to said motor to cause dispensing of one of said labels and to then disconnect the battery from the motor.

16. The dispenser of claim 15 having means for momentarily reducing the voltage of said battery when the battery is initially connected to said motor and thereafter increasing the voltage.

17. The dispenser of claim 15 having means for short circuiting said motor when it is not connected to said battery, to dynamically brake the motor.

* * * * *

UNITED STATES PATENT AND TRADEMARK OFFICE

CERTIFICATE OF CORRECTION

PATENT NO. : 3,955,711

DATED : May 11, 1976

INVENTOR(S) : Carl Schröter and Friedrich Kirchdörfer

It is certified that error appears in the above-identified patent and that said Letters Patent are hereby corrected as shown below:

Column 4, line 58, after "label" insert --26--

Column 8, line 38, after "dispenser" insert --having--

Signed and Sealed this

Fourteenth Day of September 1976

[SEAL]

*Attest:*

RUTH C. MASON
*Attesting Officer*

C. MARSHALL DANN
*Commissioner of Patents and Trademarks*